US005689288A

United States Patent [19]

Wimmer et al.

[11] Patent Number: 5,689,288

[45] Date of Patent: Nov. 18, 1997

[54] INK LEVEL SENSOR

[75] Inventors: Guenther W. Wimmer; Richard S. Meissner, both of Portland; David L. Knierim, Wilsonville, all of Oreg.

[73] Assignee: Tektronix, Inc., Wilsonville, Oreg.

[21] Appl. No.: 261,589

[22] Filed: Jun. 17, 1994

[51] Int. Cl.[6] ..... B41J 2/195

[52] U.S. Cl. ..... 347/7; 73/290 V

[58] Field of Search ..... 347/7; 340/384.6, 340/618, 625; 116/109, 227; 73/290 V

[56] References Cited

U.S. PATENT DOCUMENTS

| | | | |
|---|---|---|---|
| 3,820,098 | 6/1974 | Demyon et al. | 340/625 |
| 4,193,010 | 3/1980 | Kompanek | 310/330 |
| 4,580,147 | 4/1986 | DeYoung et al. | 346/140 R |
| 4,593,292 | 6/1986 | Lewis | 346/1.1 |
| 4,607,266 | 8/1986 | DeBonte | 346/140 PR |
| 4,609,924 | 9/1986 | DeYoung | 346/1.1 |
| 4,636,814 | 1/1987 | Terasawa | 347/7 |
| 4,658,274 | 4/1987 | DeYoung | 346/140 R |
| 4,682,187 | 7/1987 | Martner | 346/140 R |
| 4,742,364 | 5/1988 | Mikalsen | 346/140 R |
| 4,814,786 | 3/1989 | Hoisington et al. | 346/1.1 |
| 4,873,539 | 10/1989 | DeYoung | 346/140 R |
| 5,220,310 | 6/1993 | Pye | 340/624 |
| 5,315,317 | 5/1994 | Terasawa et al. | 347/7 |

*Primary Examiner*—Benjamin R. Fuller
*Assistant Examiner*—Craig A. Hallacher
*Attorney, Agent, or Firm*—Ralph D'Alessandro; Charles F. Moore; Michael L. Levine

[57] ABSTRACT

A flexible bar connected to an actuator is suspended within an ink reservoir. The bar is preferably mounted in a cantilever or free-standing mode and vibrates in response to signals from the actuator. When the actuator signals are discontinued the bar continues to vibrate and causes the actuator to generate signals that are analyzed to determine the level of ink in the reservoir.

18 Claims, 5 Drawing Sheets

D Q
120
126
STATE ENCODER
END OF 6
142
S
CLK
R
UP/DOWN
7
128
HIGH 0,1,$t_1$,$t_2$
DRIVER
DECODE
HIGH 2,3
4
5
END OF 3
END OF 4
144
134
POLARITY
108
FROM FIG.9A
112
+VDD
−VSS
$X_1$
$X_0$
$Y_1$
$Y_0$
$Z_1$
$Z_0$
A
B
C
G
X
Y
Z
110
Y
24
K
C
M
DEBOUNCE
106
MUX
Q
A SEL B
74HC4053 MUX

INK LEVEL SENSOR

TECHNICAL FIELD

The present invention relates to a method and an apparatus for sensing the level of ink in an ink reservoir and, in particular, for employing a vibratory bar to provide a feedback signal representative of continuous changes in the level of an ink in the reservoir. It is particularly useful in sensing the level of phase change ink in its molten or liquid state in the reservoir.

BACKGROUND OF THE INVENTION

Ink jet printers eject ink onto a print medium, such as paper, in controlled patterns of closely spaced dots. Two commonly used inks are aqueous ink and phase change or hot melt ink. Phase change ink typically has a liquid phase when it is above the melting temperature, for example 86° C., and a solid phase when it is at or below the melting temperature.

Phase change ink in its solid phase is conveniently stored, transported, and inserted into an ink jet printer assembly. However, for phase change ink to be properly ejected from a print head, the ink must be in the liquid phase and relatively hot. Because phase change ink typically requires a few minutes to melt after heat has been applied to it, a supply of melted ink having the proper temperature for the print head to eject is desirable. However, continuously heating a large unused ink supply is undesirable because such chronic "cooking" may degrade the ink.

U.S. Pat. No. 4,742,364 of Mikalsen describes a tubular housing for melting solid phase change ink into an ink reservoir. The tubular housing is equipped with a light source and a detector which indicate that the quantity of solid ink has dropped below a specific level when the solid ink no longer blocks the light from reaching the detector. The reservoir includes a level detect circuit the details of which are neither described nor shown.

U.S. Pat. No. 4,682,187 of Martner describes an ink reservoir adapted for melting solid granules of ink. The ink reservoir includes a valve connected to a float section responsive to the level of ink in the reservoir. When the ink in the reservoir reaches a particular level, the valve element blocks the gravity-aided movement of granular ink into the reservoir.

U.S. Pat. No. 4,609,924 of DeYoung describes a buffer reservoir having a level sensing means. The buffer reservoir is equipped with a heating element to maintain the ink in liquid state and utilizes a capacitive sensing means or thermocouple to sense the ink temperature, which varies as a function of the level of melted ink. The buffer reservoir also includes a buffer valve control responsive to a head level sensing means that determines when the level of ink within the head has dropped below a predetermined level.

U.S. Pat. No. 4,607,266 of DeBonte describes an ink reservoir having low and out-of-ink level sensing elements which may comprise thermistors, RF level sensors, or other electrical sensor means.

U.S. Pat. No. 4,593,292 of Lewis describes an ink reservoir having a level detect circuit which can determine when the level of ink within the reservoir is low. The ink melt chamber employs a light source and light detector or a micro-switch actuator to determine when the amount of solid ink has dropped below a certain level.

U.S. Pat. No. 4,580,147 of DeYoung, et al. describes an ink level sensor that provides an indication of a low ink level.

U.S. Pat. No. 4,814,786 of Hoisington, et al. describes a low ink level detector that includes a floating ball arranged to engage a contact when the level of ink in the reservoir drops below a desired level.

U.S. Pat. No. 4,658,247 of DeYoung describes a pair of ink level detectors positioned to determine the level of ink in the area of a sump. Detectors are connected to indicators or automatic means for signaling the ink levels, so that additional ink can be supplied to the reservoir when needed. One of the level sensors is suitably set to provide a low level indication with the margin of safety so that the priming or repriming operation is terminated safely before air is permitted to pass up through the feed tube.

U.S. Pat. No. 4,873,539 of DeYoung describes level sensing elements that may comprise RF level sensor or other electrical sensor means.

Co-pending U.S. patent application Ser. No. 08/034,915 of Deur et al., filed Apr. 26, 1993 and assigned the assignee of the present invention, describes ink level sensing probes that can determine whether a liquid ink reservoir is empty (i.e., too low to print and too low for the initiation of a purging cycle) and whether the ink level is such that a solid ink stick should be added. The level sensing probes are preferably conductivity probes having two exposed pads and a resistor positioned between them. The reservoir acts as the ground potential. The pads are placed at the one stick and empty levels. Voltage sensors are connected between a central processing unit and the level sensing probes. The voltage sensed by the probes changes when the pads become exposed.

Alternatively, the level sensing probes could be printed circuit boards having two thermistors electrically wired together either in parallel or in series. When electrical current is supplied, the heat loss of thermistors differs when they are in air and when they are in ink. When the heat loss changes, the resistance of the thermistors changes and is sensed by the voltage sensors, which are interfaced between the ink level sensing probes and a central processing unit. As a consequence, ink level sensing is independent of the temperature of operation of the apparatus. A film of ink can be sensed around the thermistors prior to the time all of the ink in the reservoirs is melted. An additional thermistor or conductivity pad could be placed at the full level to allow the central processing unit to detect an overflow condition.

Most conventional techniques require direct electrical or thermal contact with molten ink to determine whether the ink level is above or below preset (hard-wired) levels in an ink reservoir. Such techniques have been found to degrade certain types of ink over time. One such technique employs a self-heating thermistor probe that heats more slowly than when it is immersed in ink.

Some other ink level sensors determine the ink level by detecting the electrical conductivity of the molten ink. Some recent inks, however, exhibit reduced electrical conductivity because troublesome ionic impurities have been removed from these inks.

Therefore, it would be desirable to provide a method and an apparatus for nondestructively and proportionately detecting the level of inks, especially nonconductive inks, in an ink reservoir.

SUMMARY OF THE INVENTION

An object of the present invention is, therefore, to provide a method and an apparatus for determining the level of ink in an ink reservoir.

Another object of the invention is to provide a method and an apparatus for determining the level of ink in an ink reservoir that does not degrade phase change inks.

A further object of the invention is to provide a method and an apparatus for determining the level of ink in an ink reservoir that utilizes neither direct thermal nor electrical contact with the ink.

A piezoelectric ceramic such as PZT bonded to a stainless steel bar or beam is used to determine the level of ink in a reservoir. The bar has a fundamental resonance mode when it is vibrating that can be both stimulated and measured through the piezoelectric ceramic piece. Depending upon the configuration, immersion in the ink changes primarily the resonance frequency or the damping factor. Either factor can be measured electronically and used to provide an ink level signal.

These and other objects, features and advantages of the present invention will be apparent from the accompanying detailed description of preferred embodiments, especially when taken in conjunction with the accompanying drawings.

DETAILED DESCRIPTION OF PREFERRED EMBODIMENTS

Figure 1:
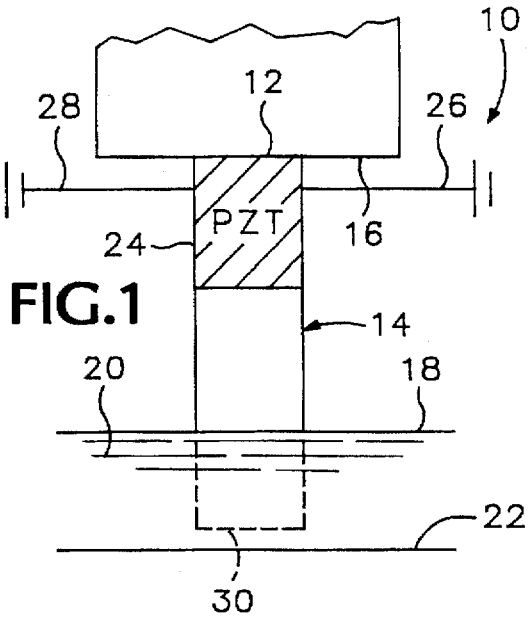
FIG. 1 is an enlarged, simplified, front view of a preferred embodiment of a cantilever-type ink level sensor of the present invention positioned within an ink reservoir.

FIG. 1 shows an enlarged, simplified front view of a cantilever-type embodiment of an ink level sensor 10 of the present invention. With reference to FIG. 1, a base 12 of a vibratory bar 14 is rigidly secured to or within a mounting surface 16 that may be part of an ink jet head. Vibratory bar 14 is positioned within or above each of preferably four separate color ink chambers in an ink reservoir (not shown) and is preferably made of stainless steel, or a similar, durable, resiliently flexible, and conductive material. A top-mounted vibratory bar 14 is positioned so that it extends through surface level 18 of ink 20 and almost to bottom surface 22 of the ink reservoir.

A suitable ceramic actuator 24, such as a ceramic piezoelectric transducer, hereinafter referred to as PZT 24, is partly bonded by epoxy glue to vibratory bar 14, and electrodes 26 and 28 of opposite polarity are respectively connected to PZT 24 and vibratory bar 14. Skilled persons will appreciate that ink level sensor 10 may alternatively employ numerous other motion generating means such as an electromagnetic coil or other appropriate transducers.

An exemplary vibratory bar 14 has a length of 23.2 mm, a width of 7.3 mm, and a thickness of 0.2 mm. However, numerous embodiments for vibratory bar 14 are possible. For example, vibratory bar 14 could be nearly as wide as the ink chamber or may be widest at the end adjacent to the PZT and taper to a much narrower width at its free end 30. Persons skilled in the art will also appreciate that PZT 24 may come in contact with ink 20. Accordingly, PZT 24, its bonding epoxy, and its electrical connections are adapted for chemical compatibility with ink 20 or coated or otherwise sealed from contact with ink 20, such as with a conformal silicon rubber coating.

Figure 2:
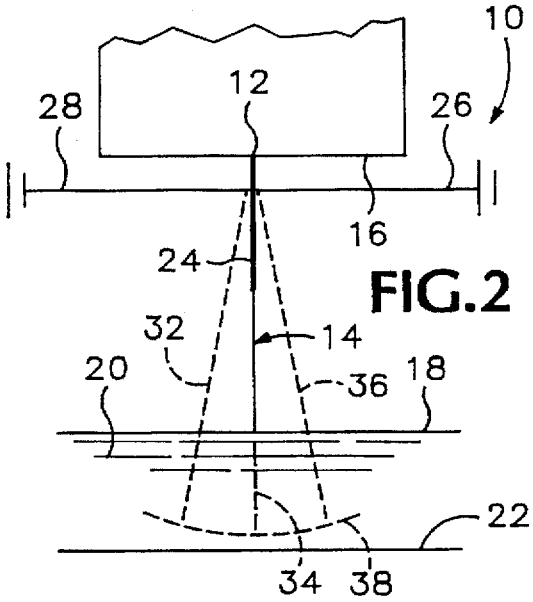
FIG. 2 is a side view of the ink level sensor depicted in FIG. 1 with exemplary vibratory movement shown in phantom.

FIG. 2 is a side view of ink level sensor 10 with vibratory bar 14 in three exemplary vibratory positions 32, 34, and 36 shown in phantom. With reference to FIG. 2, surface level 18 of ink 20 is determined in the manner described below. A central processing unit (not shown) sends one or more electrical pulses to PZT 24 at about its center frequency causing vibratory bar 14 to move back and forth along a short arc 38. When the electrical signals are discontinued, vibratory bar 14 continues to move and causes PZT 24, which acts as a detector, to generate a voltage. The frequency of the measured voltage waveforms across PZT 24 is monitored for several cycles after the applied electrical pulses have been discontinued and analyzed by the CPU to determine the degree of immersion of vibratory bar 14 into ink 20.

Figure 3:
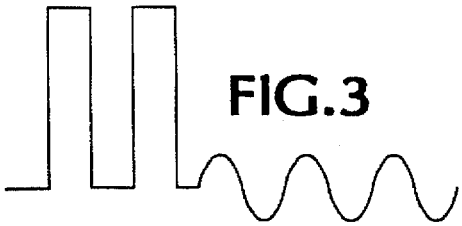
FIG. 3 shows an exemplary waveform generated by the ink level sensor of FIG. 1 indicating that the ink reservoir is empty.
Figure 4:
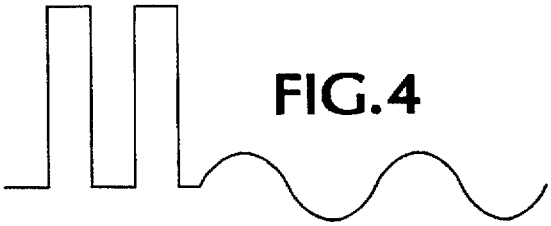
FIG. 4 shows an exemplary waveform generated by the ink level sensor of FIG. 1 indicating that the ink reservoir is full.

FIGS. 3 and 4 show exemplary waveforms generated by a PZT 24 of a piezoelectric ceramic type in response to movement of vibratory bar 14 indicating that the ink reservoir is empty or full, respectively. With reference to FIGS. 3 and 4, the frequency value of the voltage waveforms measured across PZT 24 is highest when the ink reservoir is empty and lowest when the ink reservoir is full. Moreover, any frequency within the continuous range between these values is measurable and indicates a specific surface level 18 of ink 20 between empty and full.

An example of how the frequency may be correlated to a specific surface level 18 is described as follows. It should be noted that the ink referred to hereafter as "test ink" was a fluid formulated for convenience for test purposes where the density is known to be greater than "real ink." However, the viscosity, which is a damping component, matches "real ink". For a uniform load cantilever-type embodiment (hinged at one end) such as that described in connection with FIGS. 1 and 2, the resonant frequency of the variable end load represented as a function of ink level (bar immersion depth) using "test ink" can be determined from the following defined parameters and expressions:

| | |
|---|---|
| $d_f = 1.07 \cdot \frac{gm}{cm^3}$ | Density "Test Ink" (71% Ethylene Glycol, 29% Water) formulated for concept verification to match viscosity of "Real Ink" |
| $d_i = .77 \cdot \frac{gm}{cm^3}$ | Density of "Real Ink" at 140° C. for comparative purposes only. Change in resonant frequency will be less for a given change in probe immersion depth using "Real Ink" as opposed to "Test Ink" |
| $K_1 = 3.52$ | Constant defining vibration mode of a simple uniform load cantilever hinged at one end (no ink), mode = 1 (one resonant node, fundamental resonance) |
| $K_w = 1.732$ | Constant defining vibration mode of a simple unifrom load cantilever hinged at one end plus an end load represented by the weight of ink proportionate to probe immersion depth, mode = 1 |
| $E = 30 \cdot 10^6 \cdot psi$ | Modulus of elasticity of Stainless Steel (lbs/in^2) |
| $l = 2.324$ cm | Length of beam |
| $b = .7264$ cm | Width of beam |
| $h = .02032$ cm | Thickness of beam |
| $I = \frac{1}{12} \cdot b \cdot h^3$ | Area moment of inertia |
| $m = 7.75 \cdot \frac{gm}{cm^3}$ | Density of Stainless Steel |
| $w = b \cdot h \cdot m$ | Force per unit length |
| Max Depth = .635 cm | Maximum immersion depth of probe (.25") |
| $N = 25 \qquad i = 0 \ldots N$ | |
| $L_i = 1 - \left[ .5 \cdot \left( MaxDepth \cdot \frac{i}{N} \right) \right]$ | Effective cantilever length as a function of immersion depth |
| $W_i = b \cdot \left( MaxDepth \cdot \frac{i}{N} \right)^2 \cdot d_f$ | Load contribution of ink as a function of immersion depth |

Resonant frequency of simple end hinge cantilever (no ink influence)

$$fc = \frac{K_1}{2 \cdot \pi} \cdot \sqrt{\frac{E \cdot I}{w \cdot l^4}} \qquad \frac{fc}{Hz} = 314.335$$

Resonant frequency as a function of ink level (probe immersion depth) using "Test Ink"

$$f_i = \frac{K_w}{2 \cdot \pi} \cdot \sqrt{\frac{E \cdot I}{W_i \cdot (L_1)^3 + .236 \cdot w \cdot (L_1)^4}}$$

The behavioral model for concept analysis employs a very simple three dimensional model of ink load comprised of ink in proximity to the immersed portion of the cantilever. Fluidic boundary conditions are not modeled, consequently the predicted response diverges from measured response at increasing immersion depths for a constant cross section cantilever. The response may be linearized by modifying the end shape of the cantilever.

Table I presents a comparison between theoretical values derived from the equations above and values experimentally determined to provide an exemplary conversion table between frequency and depth.

TABLE I

| Depth (mm) | Predicted Actual $f_w(I_d)$ (Hz) | Frequency (Hz) | Depth (mm) | $f_w(I_d)$ (Hz) | Frequency (Hz) |
|---|---|---|---|---|---|
| 0.000 | 318.377 | 310 | 0.330 | 235.511 | 242 |
| 0.025 | 320.600 | 306 | 0.356 | 227.348 | 237 |
| 0.051 | 320.317 | 301 | 0.381 | 219.617 | 231 |
| 0.076 | 317.668 | 295 | 0.406 | 212.325 | 227 |
| 0.102 | 312.938 | 290 | 0.432 | 205.466 | 223 |
| 0.127 | 306.504 | 285 | 0.457 | 199.026 | 219 |
| 0.152 | 298.778 | 280 | 0.483 | 192.987 | 214 |
| 0.178 | 290.163 | 275 | 0.508 | 187.328 | 210 |
| 0.203 | 281.015 | 269 | 0.533 | 182.027 | 207 |
| 0.229 | 271.632 | 264 | 0.559 | 177.061 | 204 |
| 0.254 | 262.243 | 259 | 0.582 | 172.409 | 199 |
| 0.279 | 253.021 | 253 | 0.610 | 168.049 | 195 |
| 0.305 | 244.084 | 248 | 0.635 | 163.961 | 190 |

Skilled persons will appreciate that vibratory bar 14 may alternatively be anchored at the bottom surface 22 of the ink reservoir. In this embodiment, the unanchored end 30 may protrude through surface level 18 and generate different waveforms over the continuum from empty to full. Alternatively, vibratory bar 14 may be side-mounted and sufficiently wide to cover a desired range of surface levels, such as 0.12–0.26 mm above bottom surface 22.

Figure 5:
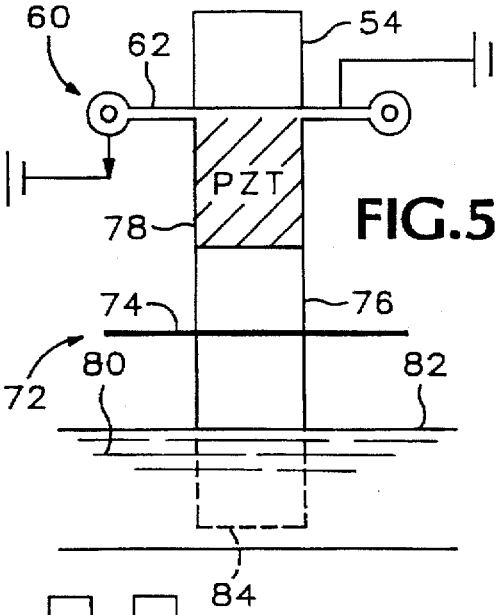
FIG. 5 is an enlarged, simplified, front view of a preferred embodiment of a free-standing-type ink level sensor of the present invention positioned within an ink reservoir.
Figure 6:
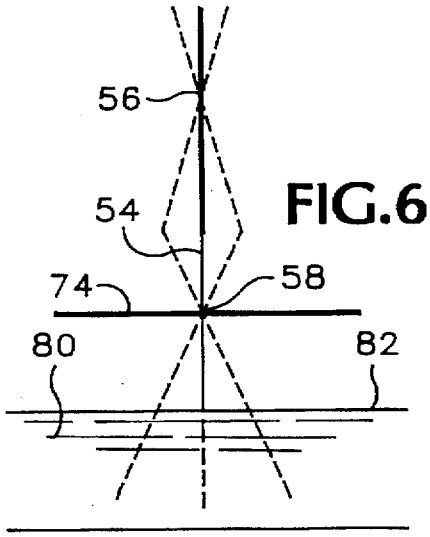
FIG. 6 is a side view of the ink level sensor depicted in FIG. 5.

In an alternative embodiment of the present invention shown in FIGS. 5 and 6, the damping factor is measured using a vibratory bar 54 in its free-standing resonant mode rather than as a cantilever. Vibratory bar 54 is supported at upper and lower nodes 56 and 58, respectively. Upper support 60 corresponding to upper node 56 is a torsional beam 62 that may be made by a thin area stamped into a stainless steel sheet. Lower support 72 corresponding to lower node 58 is a horizontal silicone rubber sheet 74 molded onto vibratory bar 54. Horizontal sheet 74 protects upper part 76 of the vibratory bar 54 and keeps actuator 78 from contacting ink 80.

When surface level 82 rises to contact bottom 84 of vibratory bar 54, the extra mass of ink 80 moves lower node 58 down away from horizontal sheet 74. Since vibratory bar 54 attempts to vibrate at the point it goes through horizontal sheet 74, the horizontal sheet 64 damps the vibration.

Figure 7:
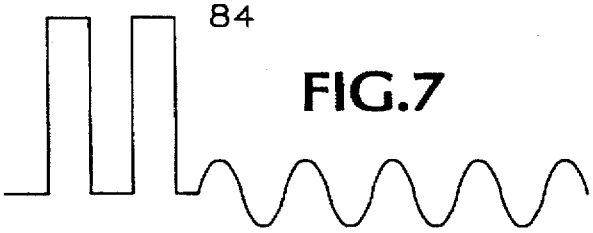
FIG. 7 is shows an exemplary waveform generated by the ink level sensor of FIG. 5 indicating that the ink reservoir is empty.
Figure 8:
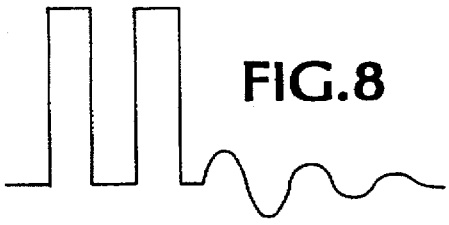
FIG. 8 shows an exemplary waveform generated by the ink level sensor of FIG. 5 indicating that the ink reservoir is full.

This embodiment may be driven in the same manner as that described for the first embodiment. During the measurement period after the drive pulse(s) have ended, the decay rate of the received signal is monitored instead of its frequency as shown in FIGS. 7 and 8.

Figure 9A:
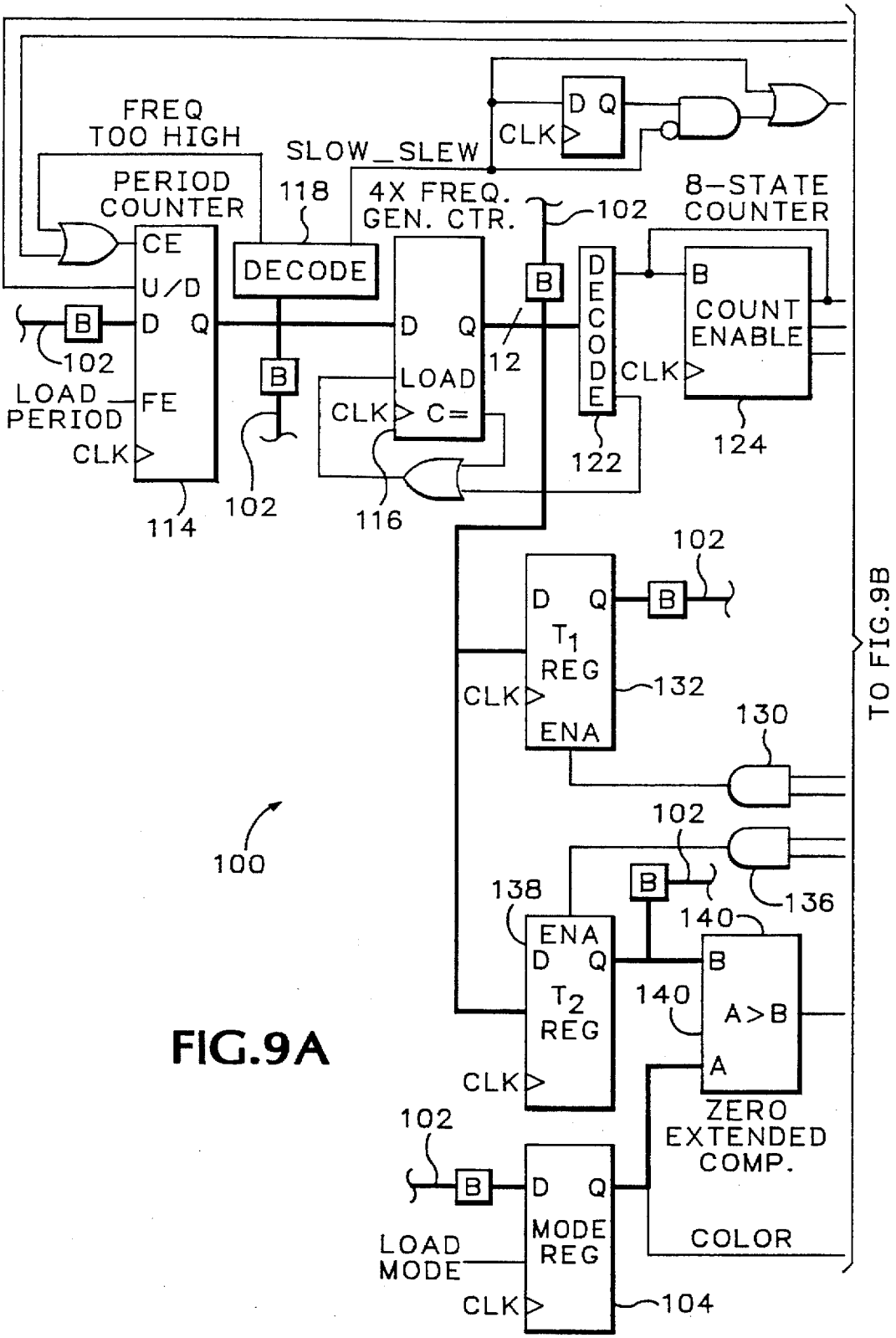
FIGS. 9A and 9B are a simplified schematic diagram showing a preferred embodiment of an ink level sensing circuit according to this invention.
Figure 9B:
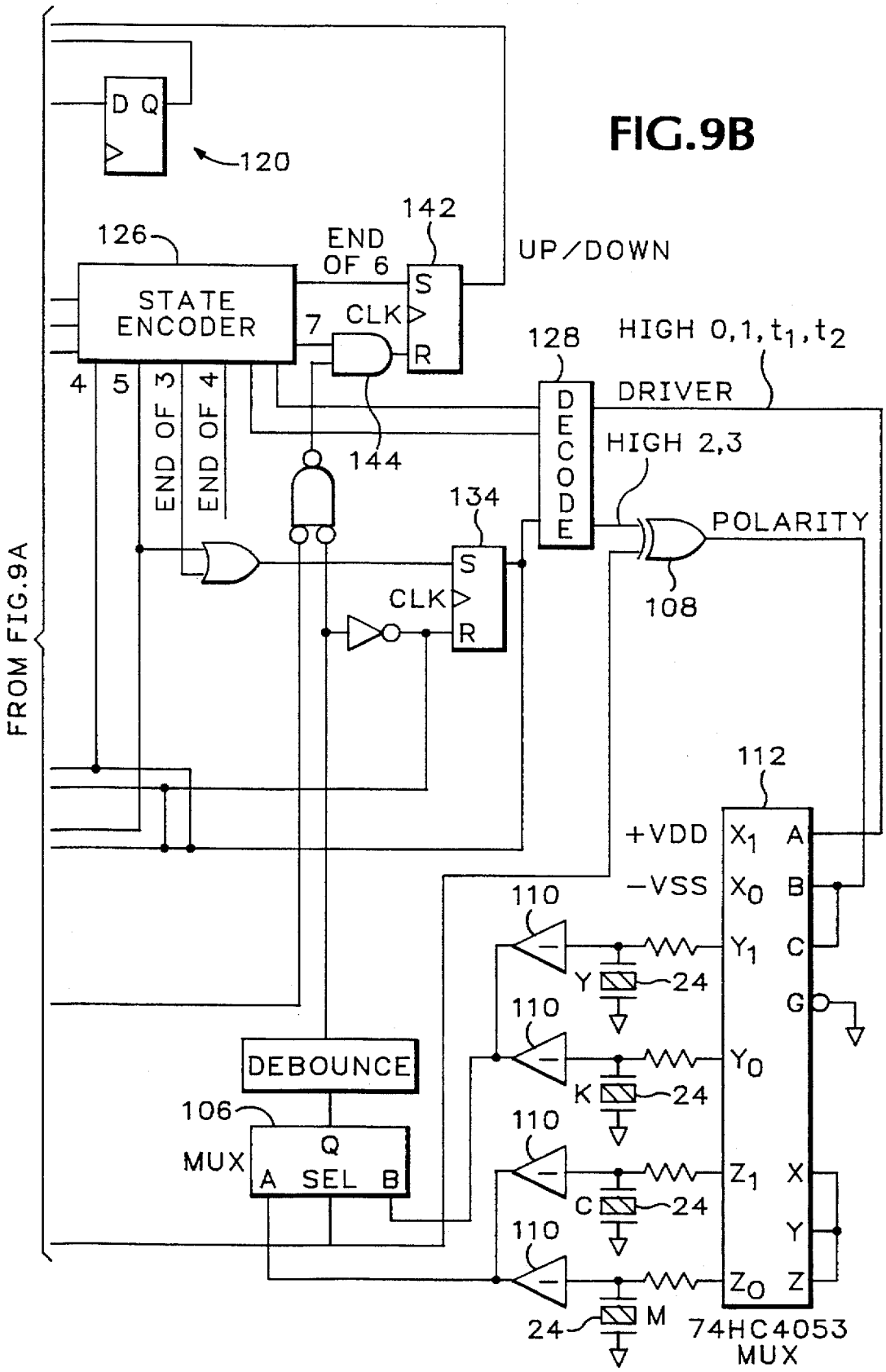
Figure 10:
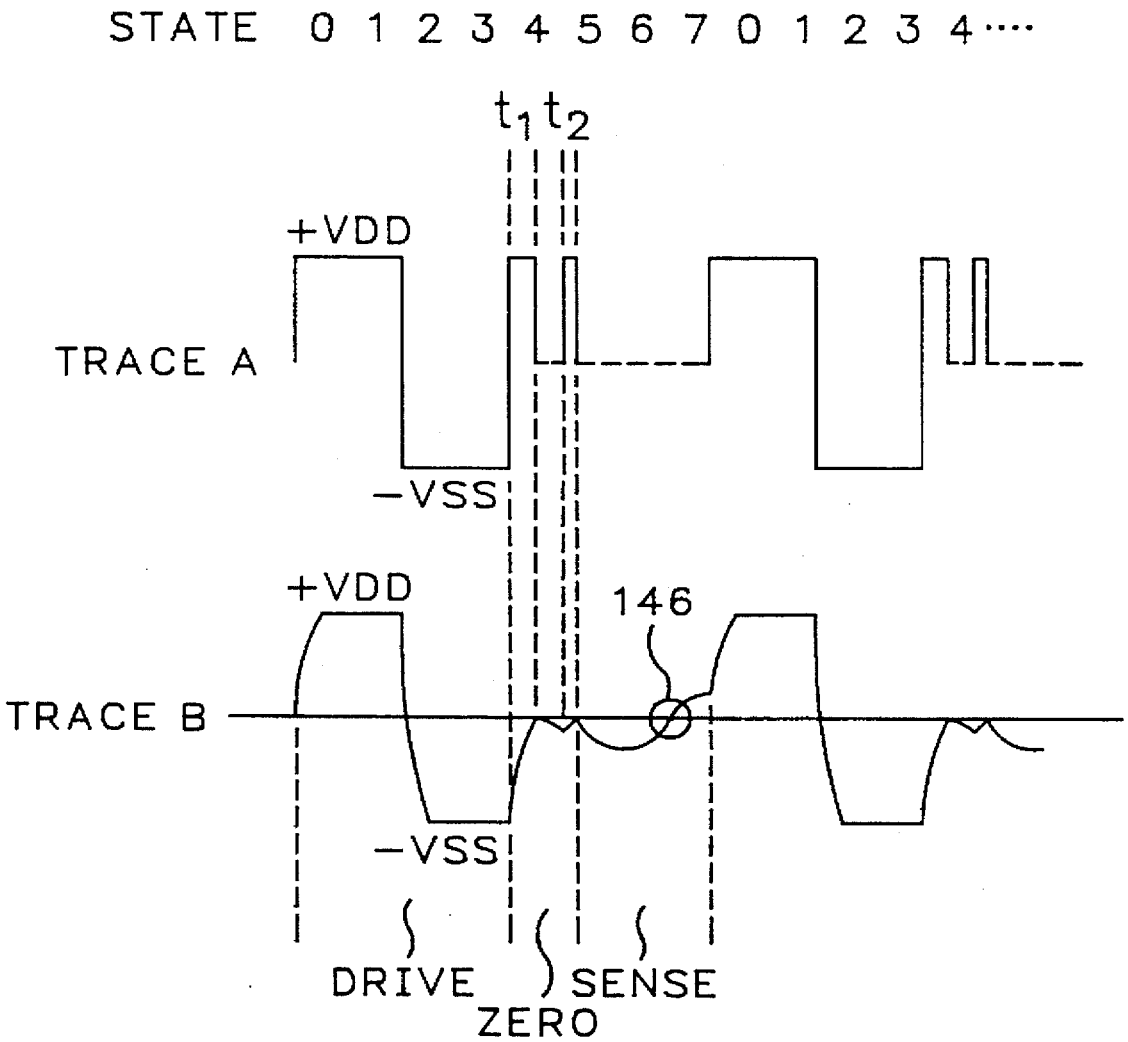
FIG. 10 is an electrical waveform diagram showing a piezoelectric transducer ("PZT") drive waveform and a corresponding sensed PZT waveform generated during eight operational states of the circuit of FIG. 9.
Figure 11:
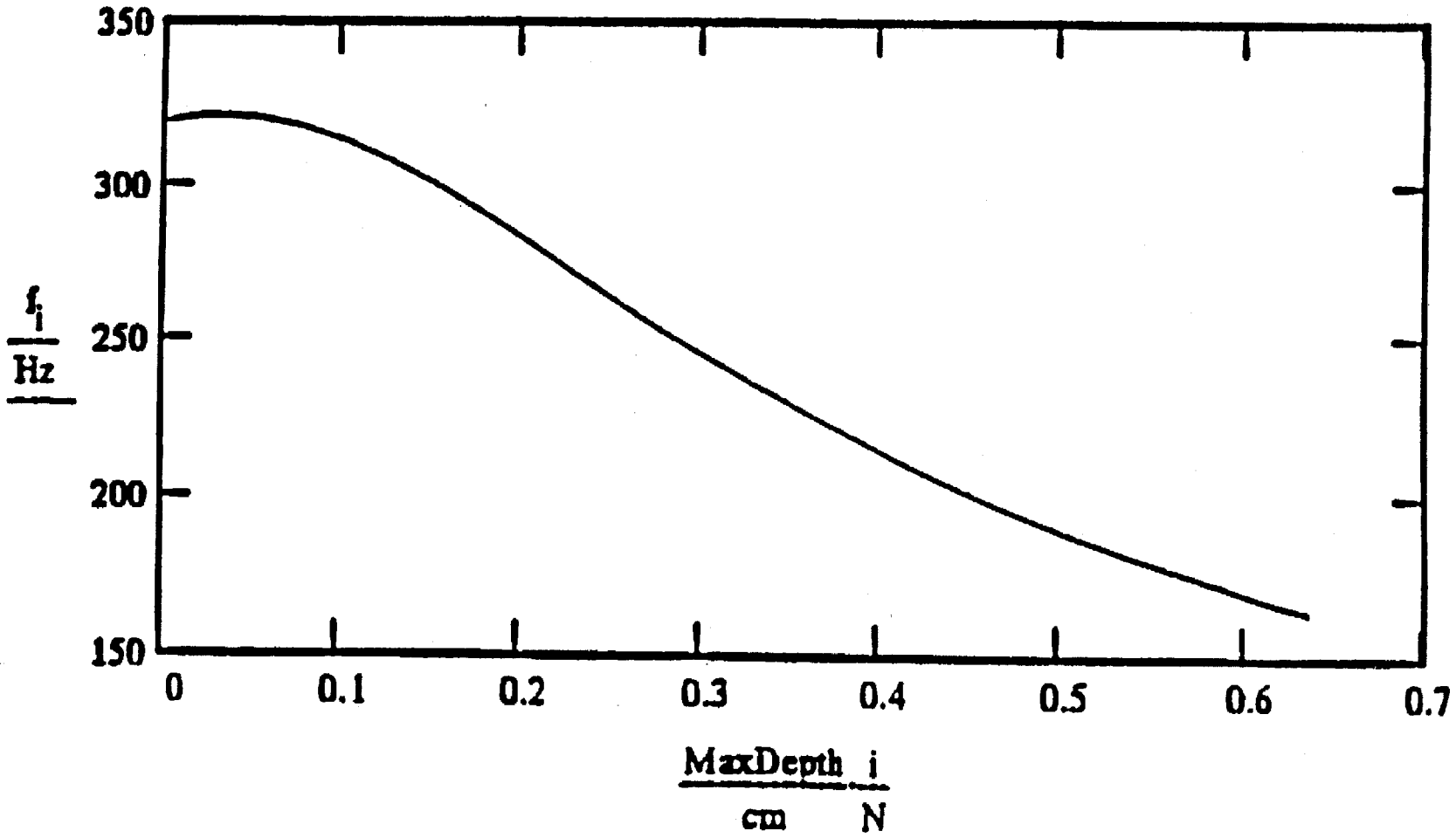
FIG. 11 is a graphical representation of the frequency as a function of the ink level of the ink supply in the ink reservoir.

A preferred embodiment of an electrical circuit for sensing the ink level is described below with reference to FIGS. 9A, 9B and 10. An ink level sensing circuit 100 drives a selected PZT 24 with a drive waveform (Trace A) and senses a corresponding PZT waveform (Trace B) to determine a resonant frequency for the PZT. The resonant frequency corresponds, as described above, to a predetermined ink level.

Circuit 100 preferably makes multiple resonant frequency determinations before a conventional processor (not shown) switches circuit 100 to another one of PZTs 24. Selecting a particular one of PZTs 24 proceeds as follows. A preferred embodiment includes four ink reservoirs, one for each of yellow ("Y"), magenta ("M"), cyan ("C"), and black ("K") inks. (Hereafter particular ones of PZT 24, or other components, are referred to by an applicable color suffix, e.g., PZT 24C or PZTs 24CM. The PZTs are referred to collectively as PZTs 24.) The processor drives a bus 102 with a 6-bit mode control signal that is loaded into a mode register 104. Bus 102 is conventionally sensed and/or driven at multiple locations in circuit 100 by tri-state logic elements B. Two bits of the mode control signal control the PZT ink level color being measured, and four bits control a sensing threshold value. The two color-controlling bits drive a comparator multiplexer 106 and an XOR gate 108. In response, multiplexer 106 selects a predetermined pair of wired OR comparators 110 (110YK or 110CM), and XOR gate 108 controls a drive waveform multiplexer 112 to drive a different predetermined pair of PZTs 24 (24YC or 24KM). Mode register 104 selects, therefore, a particular one of PZTs 24 for simultaneously driving and sensing.

More particularly, circuit 100 generates a predetermined frequency for trace A, senses a selected PZT 24, determines whether the sensed voltage is greater than the threshold value, determines whether the phase of the sensed voltage leads or lags a predetermined phase, and steps the generated frequency up or down so that the sensed voltage will exceed the threshold value and match the phase. When the frequency is such that the threshold value is exceeded and the phase is matched, trace A is being generated at the resonant frequency of the selected PZT 24 and the ink level is determined by the processor reading this frequency.

To generate a starting frequency for trace A, the processor loads a preset period value into an up/down period counter 114 that loads the period value into a frequency generating counter 116 that repetitively counts up from the period value to 4095 to generate a frequency eight times that of trace A (four times the beam resonant frequency). A decoder 118 detects a pair of predetermined period ranges and generates "frequency too high" and "slow slew" signals that maintain frequency counter 116 within usable frequency and rate-of-frequency change ranges. In response to the slow slew signal, divider logic 120 reduces by a factor of two the up/down stepping frequency of period counter 114. The starting frequency is preferably the last measured frequency for the particular PZT 24 currently being measured.

A decoder 122 decodes a three-quarter scale count of frequency counter 116 to drive an 8-state counter 124, which drives a state encoder 126 that generates eight state signals (0–7) that sequence and control the various controlling, driving, and sensing functions of circuit 100.

To generate trace A, a state decoder 128 controls drive waveform multiplexer 112 such that selected PZT 24 is driven with a $+V_{DD}$ voltage during states 0, 1, and the initial portions of states 4 and 5, a $-V_{SS}$ voltage during states 2 and 3, and a high-impedance (shown in dashed lines) during states 6 and 7 and the remaining portions of states 4 and 5. States 0, 1, 2, and 3 are active PZT 24 driving states; states 4 and 5 are "zeroing" states; and states 6 and 7 are sensing states.

States 4 and 5 entail a combination of active driving and sensing to initialize subsequent threshold value and phase measurements that are performed as follows.

During state 4, as shown in Traces A and B, the selected PZT 24 voltage is driven from $-V_{SS}$ toward zero. When the voltage crosses zero, the one of comparators 110 selected by comparator multiplexer 106 changes states causing gate 130 to capture the value of frequency counter 116 in $T_1$ register 132, and to reset a set/reset flop-flop 134 that causes state decoder 128 to switch drive waveform multiplexer 112 to drive the selected PZT 24 with a high-impedance.

During state 5, the selected PZT 24 voltage is again driven toward zero. When the voltage crosses zero, the one of comparators 110 selected by comparator multiplexer 106 changes states causing gate 136 to capture the value of frequency counter 116 in $T_2$ register 138 and to reset set/reset flop-flop 134 as before. $T_1$ register 132 and $T_2$ register 138 store values corresponding to the time required by the voltage on the selected PZT 24 to change from a predetermined value to zero during the start of respective states 4 and 5.

The ratio of $T_1$:$T_2$ values is an accurate representation of the amplitude of the voltage generated by the selected PZT 24 in response to being actively driven during states 0–5. The mathematical basis for determining the values $T_1$ and $T_2$ is set forth below:

The PZT resonant signal amplitude is:

$$Vsig(PK)=[e^{-((T_2 ln(V_{DD}/(V_{DD}-V_{SS}))/T_1)}-1]V_{SS},$$

where:

$T_1$=counts read for autozero cycle 1;
$T_2$=counts read for autozero cycle 2;
$V_{DD}$=+5V; and
$V_{SS}$=−5V Vsig will equal the sum of the resonant signal amplitude and dielectric absorption signal artifact of the PZT, i.e., Vsig (actual) equals Vsig—Vsig (dielectric). The dielectric absorption signal artifact may be evaluated and saved just prior to ink phase change from solid to liquid.

If the frequency of Trace A is sufficiently close to resonance of the selected PZT 24, its generated signal amplitude will be greater than the threshold value as determined by a digital comparator 140, thereby enabling a phase detecting flip-flop 142. Flip-flop 142 is set at the end of state 6 to place period counter 114 in the up-count mode. Counting the period up causes frequency counter 116 to step up one step in frequency for each eight states of state encoder 126 until a phase lock is achieved.

Phase lock is achieved by sensing the selected PZT 24 voltage value during state 7. An in-phase condition is indicated at point 146 in Trace B in which the PZT 24 voltage crosses through zero during the transition from state 6 to state 7. A gate 144 holds flip-flop 142 in the down-count state unless the selected one of comparators 110 senses that the PZT 24 voltage is above zero; otherwise, flip-flop 142 remains set in the up-count mode. Thus, circuit 100 seeks a frequency responsive to the resonant frequency of PZT 24 such that the sensed voltage amplitude is above a threshold value and is about zero during the transition from state 6 to state 7.

Skilled workers will recognize that the processor can determine the resonant frequency of PZT 24, and thereby the sensed ink level, by driving the values of $T_1$ register 132, $T_2$ register 138, and period counter 114 onto bus 102 through appropriate ones of tri-state logic elements B at predetermined times.

Skilled persons will appreciate that the analog or continuous ink level indication is highly advantageous because the ink level may be checked continuously, at intervals, or before any specific printer operation.

Another major advantage of these embodiments for sensing the surface levels 18 or 82 of inks 20 or 80 in an ink reservoir is that these embodiments utilize properties, i.e., the viscosity and the density, of the inks 20 or 80 that are already controlled to ensure proper ink jetting performance. Skilled workers will appreciate, therefore, that future ink formulations are not likely to change the operation of these ink level sensing methods.

It will be apparent to skilled persons that changes may be made to the details of the specific embodiments of the invention described herein without departing from the underlying principles thereof. The scope of the present invention should accordingly be determined only by the following claims.

We claim:

1. A device for sensing a level of ink in a reservoir in a print head of a printer, the ink having an exposed upper surface and an opposing bottom surface, comprising:

a flexible bar fastened to a mounting surface within the print head and suspended within the reservoir extending through the exposed upper surface of the ink toward the opposing bottom surface;

a PZT actuator and detector connected to the flexible bar for providing motion to the flexible bar;

a signal generator connected to the PZT actuator for generating a measured voltage signal waveform representative of the motion of the flexible bar, the signal having a frequency;

the PZT detector processing a measured voltage signal waveform representative of the motion of the flexible bar; and an analyzer associated with the PZT actuator and detector analyzing the frequency of the signal waveform across the PZT actuator and detector for converting the signal waveform into an ink level indication by defining a degree of immersion of the bar in the ink.

2. The device of claim 1 in which the ink comprises phase change components.

3. The device of claim 1 in which the bar comprises stainless steel.

4. The device of claim 1 in which the actuator comprises a ceramic material.

5. The device of claim 1 in which the signal representative of the motion of the flexible bar has a decay rate correlating to the ink level indication.

6. The device of claim 1 in which the bar is mounted to the mounting means on support means in a cantilever configuration in the reservoir.

7. The device of claim 1 in which the bar is mounted to the mounting means on support means in a free-standing configuration in the reservoir.

8. The device of claim 1 in which the ink level is measured over a continuous range.

9. The device of claim 1 wherein a plurality of flexible bars are present in a plurality of reservoirs for each of a plurality of colored inks.

10. A method for detecting a level of ink in a reservoir in a print head, the ink having an exposed upper surface and an opposing bottom surface, comprising, actuating for a short interval a PZT connected to a bar suspended within the reservoir and extending through the exposed upper surface of the ink to create motion in the bar;

generating at least one measured voltage signal waveform representative of the motion of the bar, the signal having a frequency;

sensing a measured voltage signal waveform created by the motion of the bar after the actuating interval and determining whether the sensed voltage is greater than a threshold value;

determining whether the phase of the sensed voltage signal waveform leads or lags a predetermined phase;

stepping the frequency of the generated signal waveform up or down so the sensed voltage exceeds the threshold value and matches the predetermined phase; and determining the level of ink in the reservoir from the frequency of the generated signal waveform.

11. The method of claim 10 in which the ink comprises phase change components.

12. The method of claim 10 in which the bar comprises stainless steel.

13. The method of claim 10 in which the sensed voltage signal waveform has a frequency correlating to the ink level indication.

14. The method of claim 10 in which the sensed voltage signal waveform has a decay rate correlating to the ink level indication.

15. The method of claim 10 in which the bar is mounted on support means in a cantilever configuration.

16. The method of claim 10 in which the bar is mounted on support means in a flee-standing configuration.

17. The method of claim 10 in which the ink level is measured over a continuous range.

18. The method of claim 10 wherein a plurality of flexible bars are present in a plurality of reservoirs for each of a plurality of colored inks.

* * * * *

UNITED STATES PATENT AND TRADEMARK OFFICE

CERTIFICATE OF CORRECTION

PATENT NO. : 5,689,288
DATED : November 18, 1997
INVENTOR(S) : Guenther W. Wimmer, Richard S. Meissner and David L. Knierim It is certified that error appears in the above-identified patent and that said Letters Patent is hereby corrected as shown below:

Column 10, line 37, after "a" and before "configuration" change "flee-standing" to --free-standing--.

Signed and Sealed this

Third Day of February, 1998

*Attest:*

BRUCE LEHMAN

*Attesting Officer*

*Commissioner of Patents and Trademarks*